US010119399B1

(12) United States Patent
Davis

(10) Patent No.: US 10,119,399 B1
(45) Date of Patent: Nov. 6, 2018

(54) REVERSE VANE ENGINE EXTRACTING WORK FROM HOT GAS ENTERING AN ENGINE AT AN AMBIENT PRESSURE

(71) Applicant: Brian Lee Davis, Ripon, WI (US)

(72) Inventor: Brian Lee Davis, Ripon, WI (US)

( * ) Notice: Subject to any disclaimer, the term of this patent is extended or adjusted under 35 U.S.C. 154(b) by 123 days.

(21) Appl. No.: 14/962,965

(22) Filed: Dec. 8, 2015

Related U.S. Application Data

(60) Provisional application No. 62/089,669, filed on Dec. 9, 2014.

(51) Int. Cl.

| | |
|---|---|
| ***F01C 21/04*** | (2006.01) |
| ***F03C 2/00*** | (2006.01) |
| ***F03C 4/00*** | (2006.01) |
| ***F04C 2/00*** | (2006.01) |
| ***F01C 20/24*** | (2006.01) |
| ***F01C 1/344*** | (2006.01) |
| ***F01C 21/10*** | (2006.01) |
| ***F01C 21/08*** | (2006.01) |
| ***F04C 2/344*** | (2006.01) |
| ***F04C 29/04*** | (2006.01) |

(52) U.S. Cl.
CPC ..... *F01C 20/24* (2013.01); *F01C 1/3441* (2013.01); *F01C 1/3448* (2013.01); *F01C 21/0809* (2013.01); *F01C 21/10* (2013.01); *F04C 2/3441* (2013.01); *F04C 29/04* (2013.01)

(58) Field of Classification Search
CPC ..... F01C 1/3441; F01C 1/3448; F01C 20/24; F01C 21/0809; F01C 21/10; F04C 2/3446; F04C 2/3441; F04C 29/0007; F04C 29/04; F04C 2270/18
USPC ..... 418/83, 84, 96, 101, 259, 266–268
See application file for complete search history.

(56) References Cited

U.S. PATENT DOCUMENTS

| | | | | | |
|---|---|---|---|---|---|
| 1,339,723 | A * | 5/1920 | Smith | F04C 29/02 | 418/98 |
| 2,379,938 | A * | 7/1945 | Swanson | F04C 21/0809 | 418/146 |
| 2,898,862 | A | 8/1959 | Brundage | | |
| 3,747,573 | A | 7/1973 | Foster | | |
| 4,089,174 | A * | 5/1978 | Posnansky | F04C 29/04 | 418/83 |
| 4,187,692 | A | 2/1980 | Midolo | | |
| 4,248,575 | A * | 2/1981 | Watanabe | F01C 21/0863 | 418/269 |
| 4,295,804 | A * | 10/1981 | Pezzot | F04C 29/04 | 418/83 |
| 4,316,706 | A | 2/1982 | Crooke | | |

(Continued)

*Primary Examiner* — Theresa Trieu

(74) *Attorney, Agent, or Firm* — Brannen Law Office, LLC

(57) ABSTRACT

The present invention is an engine having a housing, a rotor and a plurality of vanes. The housing has a cavity with an outer wall that has an inlet region, an insulation or hot region, a thermal separator, a chill region, a work region and a return region. The vanes define cavities that rotate between the rotor and the housing. Hot gas enters in the inlet region, which can have a slot. The cavity is full of hot gas in the insulation region. The temperature is reduced in the chill region, which causes the pressure to likewise drop to a relative low pressure. In the work region, the diameter of the outer wall is reduced. The pressure differential between successive cavities causes the rotor to turn in the direction of the decreasing wall length, whereby work can then be extracted from the engine.

14 Claims, 13 Drawing Sheets

(56) References Cited

U.S. PATENT DOCUMENTS

| | | | | |
|---|---|---|---|---|
| 5,494,424 | A * | 2/1996 | Schnell | F04C 29/04 418/83 |
| 5,522,356 | A | 6/1996 | Palmer | |
| 5,879,146 | A * | 3/1999 | Van De Voort | F04C 21/0809 418/259 |
| 7,637,724 | B2 | 12/2009 | Cygnor | |
| 8,225,607 | B2 | 7/2012 | Stegmair et al. | |
| 2011/0271674 | A1 | 11/2011 | Teng et al. | |

* cited by examiner

REVERSE VANE ENGINE EXTRACTING WORK FROM HOT GAS ENTERING AN ENGINE AT AN AMBIENT PRESSURE

This patent application claims priority on and the benefit of provisional application 62/089,669, filed Dec. 9, 2014, the entire contents of which are hereby incorporated herein by reference.

BACKGROUND OF THE INVENTION

1. Field of the Invention

The present invention relates to a reverse vane engine extracting work from a hot gas entering an engine at an ambient pressure and in particular to an engine that utilizes a pressure differential created by a partial vacuum that is formed as the gas is cooled within a cavity.

2. Description of the Related Art

Many engine types exist. Some examples of engines include combustion engines, steam engines, and wind or water driven rotary engines. While each of these engines may work well for their intended purposes, they each require a specific fuel or drive mechanisms. None of these types of engines are designed to extract work from a hot gas entering an engine at an ambient pressure that has been cooled to create a low pressure cavity.

Thus there exists a need for a reverse vane engine extracting work from a hot gas entering an engine at an ambient pressure that solves these and other problems.

SUMMARY OF THE INVENTION

The present invention is an engine having a housing, a rotor and a plurality of vanes. The housing has a cavity with an outer wall that has an inlet region, an insulation or hot region, a thermal separator, a chill region, a work region and a return region. The vanes define cavities that rotate between the rotor and the housing. Hot gas enters in the inlet region, which can have a slot. The cavity is full of hot gas in the insulation region. The temperature is reduced in the chill region, which causes the pressure to likewise drop to a relative low pressure. In the work region, the diameter of the outer wall is reduced. The pressure differential between successive cavities causes the rotor to turn in the direction of the decreasing wall length, whereby work can then be extracted from the engine.

According to one advantage of the present invention, warm or hot gasses enter the engine at ambient pressure. A relative negative pressure or partial vacuum is developed within each cavity as it is cooled. The pressure differential of the partial vacuum (seeking to decrease the volume) is utilized to drive a rotor whereby work can be performed. Rotation occurs as gasses move from lower pressure to higher pressure as the volume decreases within the work region of the engine. Cool gasses at the ambient pressure are exhausted to ambient environment at a temperature that approaches or is equal to the ambient temperature (or to another environment at another temperature).

According to another advantage of the present invention, it can operate when there is little or no pressure difference between the inlet gasses and the outlet gasses. This can result in an approximate net-zero pressure difference engine which would not require compressors to operate. To the contrary, the engine can utilize energy in hot gasses at normal or ambient pressure. This hot gas is normally vented to the environment and accordingly the energy in the normally exhausted hot gas is wasted. Advantageously, the present invention can utilize a waste product to perform work.

According to a still further advantage of the present invention, the entrance in the inlet region is slotted so gas enters at normal inlet pressure over a long rotational distance to ensure that the cavity is full of hot gas at the inlet pressure. This is accomplished over a given distance so that the inlet size is not restrictive in allowing hot gas to enter the cavities.

Related, and according to a further advantage of the present invention, the slot begins at the start of the inlet region so that the potential for a vacuum is eliminated in the inlet region. Elimination of a vacuum at this region is advantageous as a vacuum would work against the productivity of the engine.

According to a still further advantage of the present invention, there is an insulated region near inlet wherein at least one rotational section passes. The hot or insulation region allows for a full cavity of hot gas to be captured prior to any cooling wherein it can be utilized to maximize the effect of the engine by using the full potential energy in the hot gas. Put another way, any premature cooling reduces efficiency of the engine. Hence, each cavity is full of hot gas at the inlet pressure in the insulated or hot region. The length of this region can be limited to being at least as long as the outer perimeter length of a single cavity.

According to a still further advantage yet of the present invention, a thermal separator is provided that separates or insulates between the hot or insulation region and cooling or chill region. The thermal separator maintains a high efficiency or effectiveness of the insulation region by allowing the insulation region to operate at a full hot temperature to avoid or minimize any premature cooling.

According to a still further advantage yet of the present invention, the chill region is provided wherein cavity is held at constant volume as the rotor rotates the cavity through this region. This allows the pressure within the cavity to drop as temperature drops creating a partial vacuum under the ideal gas law. In one embodiment, the gas can be fully cooled to the ambient temperature prior to entering the work region wherein work is performed as the volume is reduced and the pressure in increased.

According to a still further advantage yet of the present invention, the engine can be gas, liquid or otherwise cooled in the chill region. The particulars of the application (temperature differential, rotational length of the chill region, rotational speed of the rotor, etc.) will have an effect on the cooling mechanism selected.

According to a still further advantage yet of the present invention, a work section is provided. The work section comprises an outer wall of decreasing diameter wherein the leading vane has a smaller length (between the rotor and outer wall) than the length of the trailing vane. This difference in lengths (and accordingly areas) causes the rotor to turn as the difference in length correlates to difference in force (Force=pressure times area of applied force) that is applied to the trailing and leading vanes, respectively.

According to a still further advantage yet of the present invention, pressure release plugs are provided to allow pressure to release from work area at the appropriate rotational location. In the preferred embodiment, the pressure release plugs automatically open when pressure within the cavity (due to decreasing volume) exceeds ambient pressures. Release of pressure prevents a situation wherein the motor would tend to work against itself due to high pressure developing on account of the decreasing cavity volume. The plugs could be mechanically pressure operated or electronically controlled.

Related, and according to a still further advantage yet of the present invention, the plugs can be wedge shaped (or cone shaped) to conform to like-shaped openings in wall. In this regard, the plugs would be self-sealing plugs that are pulled into mating engagement with the exhaust ports when the internal cavity pressure is less than the external ambient pressure.

The present invention can also be driven by a motor wherein it can act as a compression pump.

Other advantages, benefits, and features of the present invention will become apparent to those skilled in the art upon reading the detailed description of the invention and studying the drawings.

DETAILED DESCRIPTION OF PREFERRED EMBODIMENTS

Figure 1:
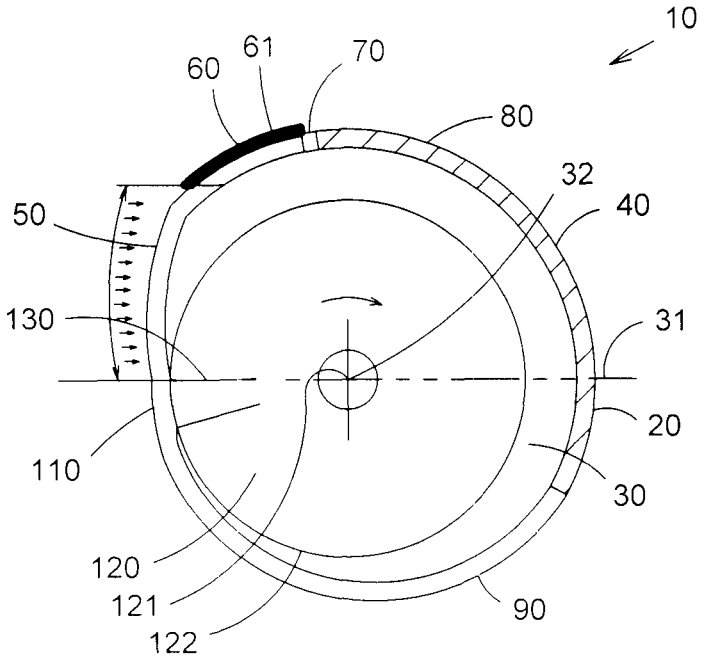
FIG. 1 is an illustration of a preferred embodiment of the present invention with a cavity shown in a return region.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

An engine 10 is provided to harness energy from a gas 5. The gas 5 preferably enters the engine as a hot gas entering an engine at an ambient pressure at a temperature above the ambient temperature of the environment. The gas preferably enters and exits the engine at or about at the same pressure. However it is understood that the gas can exit the engine at a different pressure without departing from the broad aspects of the present invention.

One embodiment of the present invention is illustrated in FIGS. 1-17. As can be seen in the figures, a housing 20 is provided. The housing 20 has a cavity 30. The cavity has a center line 31 and a center 32. An outer wall 40 is provided having an inside surface and an outside surface. The outer wall 40 has several regions. Regions include an inlet region 50, an insulation region 60, a chill region 80, a work region 90 and a return region 110. A thermal separator 70 thermally separates the insulation region 60 from the chill region 80.

A rotor 120 with a center 121 and a perimeter 122 is also provided. There are preferably 24 slots 123 formed into the perimeter 122 of the rotor. Each slot 123 receives a vane 130 (hence, 24 vanes 130 are provided). Two vanes 130 define a cavity 150 between the leading vane, trailing vane, the inside surface of the outer wall 40 of the housing cavity 30 and the perimeter 122 of the rotor 120. Each vane 130 is preferably similar. The rotor 120, and hence the cavities 150, are rotatable within the housing. While the engine is illustrated as rotating in a clockwise direction, the engine could be configured for opposite rotation without departing from the broad aspects of the present invention.

It is appreciated that more or fewer slots 123 can be provided without departing from the broad aspects of the present invention. Each slot 123 preferably has a biasing mechanism embedded wherein the respective vanes 130 are biased to extend outward therefrom until they contact the wall 40 of the cavity. One preferred biasing mechanism is a spring.

It is appreciated that while 24 vanes and cavities are shown, that more or fewer could be used without departing from the broad aspects of the present invention. Further, it is understood that each cavity independently and cumulatively contributes to the engine output as they respectively pass through the work region of the present invention.

Figure 17:
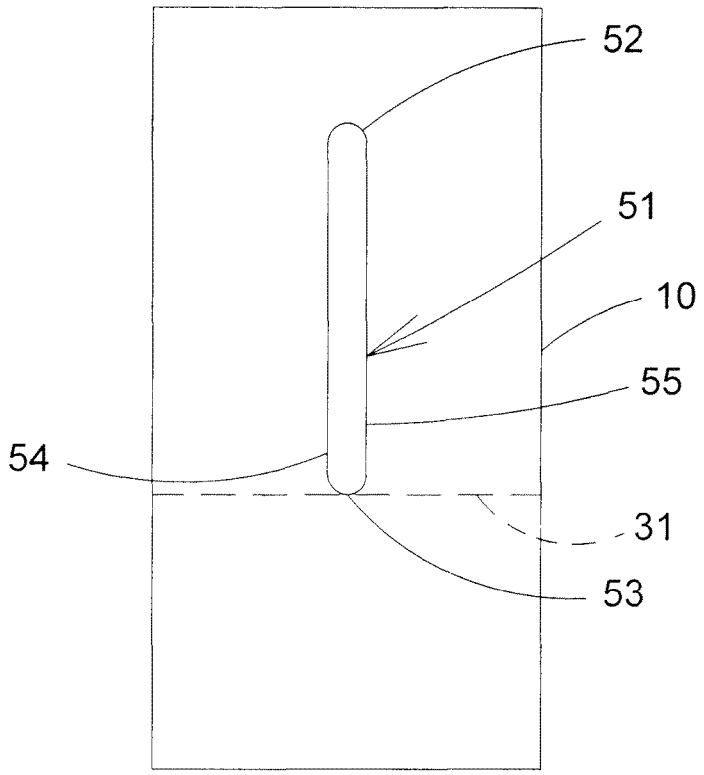
FIG. 17 is a side view of an entrance slot of the present invention.

The inlet region 50 has an inlet 51 with ends 52 and 53 and with sides 54 and 55. One preferred inlet 51 is an elongated slot. However, other shapes could be used without departing from the broad aspects of the present invention. The outer wall in the inlet region is in close proximity to the rotor at the start of the region and is at a maximum distance from the rotor at the end of the region. The distance between the rotor and outer wall 40 at the end of the inlet region is determined by the scale or size of the engine. It could range from less than in inch to greater than a few feet. The slot is shown in FIG. 17. The inlet 51 begins at the start of the inlet region 50 so that no vacuums are created in the inlet region and extends to the end of the inlet region so that a full charge of hot gas is received within the cavity when the cavity achieves maximum volume at the end of the inlet region.

The insulation region 60 or hot region follows the inlet region. The insulation region 60 preferably has insulation 61 on the outside of or embedded within the outer wall 40. The length of the insulation region is preferably equal to or slightly longer than the perimeter distance at the distal end of one cavity 150. This allows for a full cavity of hot gas to be present within the cavity prior to entering the chill region. The outer wall is a fixed distance from the rotor during the insulation region. The outer wall radius in the insulation region is preferably generally equal to the outer wall radius at the end of the inlet region 50. Any suitable insulation material may be used without departing from the broad aspects of the present invention.

A thermal separator 70 is provided. The thermal separator or barrier provides insulation and a thermal separation between the insulation region 60 and the chill region 80. The separator 70 is preferably made of a thermally insulative material. The thickness of the material can be generally small in comparison to the lengths of the adjacent regions separated by the separator 70.

Figure 14:
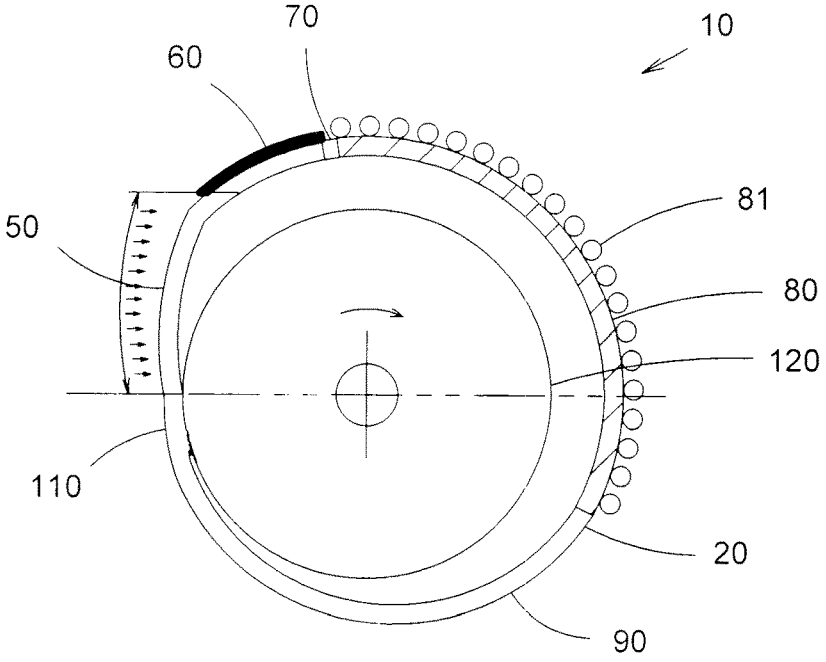
FIG. 14 is an illustration showing cooling lines in cross-sectional view in the cooling region.
Figure 15:
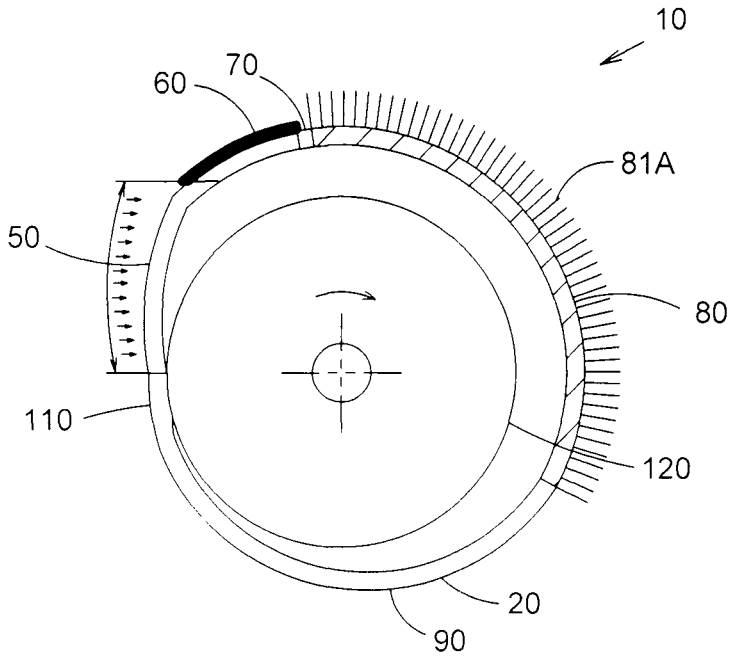
FIG. 15 is an illustration showing cooling fins in the cooling region in an alternative embodiment of the present invention.
Figure 16:
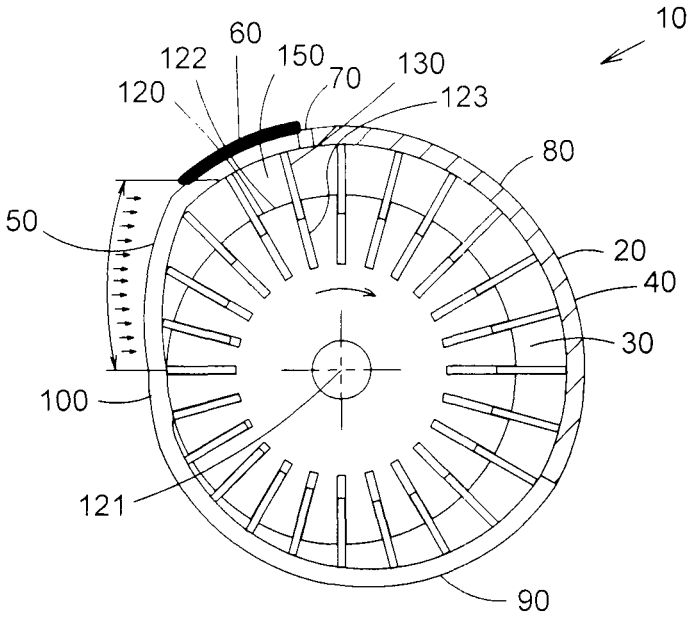
FIG. 16 is an illustration showing cavities of the present invention.

The chill region 80 has a heat exchanger at or embedded within the outer wall 40 of the cavity. As seen in FIGS. 14 and 15, the cooling can be via ports or lines 81 for liquid cooling or by fins 81A for air cooling. It is understood that even though it is preferred to cool the gas within the cavity to the ambient temperature, that the gas could be cooled to a temperature below the ambient temperature via the heat exchanger without departing from the broad aspects of the present invention. The perimeter length of the chill region (or temperature reduction region) can be between 90 and 180 degrees about the perimeter of the housing 20. It is appreciated that the distance could be greater or smaller without departing from the broad aspects of the present invention. The outer wall is preferably a fixed distance from the rotor during the chill region 80. The outer wall radius in the chill region 80 is preferably generally equal to the outer wall radius in the insulation region.

The work region 90 follows the chill region 80. In the work region 90, the outer wall 40 has a decreasing radius wherein the distance between the outer wall 40 and the rotor decreases. In a preferred embodiment, the distance between the outer wall is greatest at the beginning of the work region and approaches zero distance at the end of the work region. The transition from maximum distance differential to zero distance differential is preferably a constant or linear transition (i.e. in the shape of an Archimedean Spiral). However, the differential can change in a nonlinear or non-constant manner without departing form the broad aspects of the present invention. The work region 90 has a work region start 91 and a work region end 92. The work region start 91 is the part of the work region 90 closest to the inlet 51 measured in the rotational direction of travel of the vanes 130 and cavities 150. The work region end 92 is the part of the work region 90 farthest from the inlet 51 measured in the rotational direction of travel of the vanes 130 and cavities 150.

Figure 12:
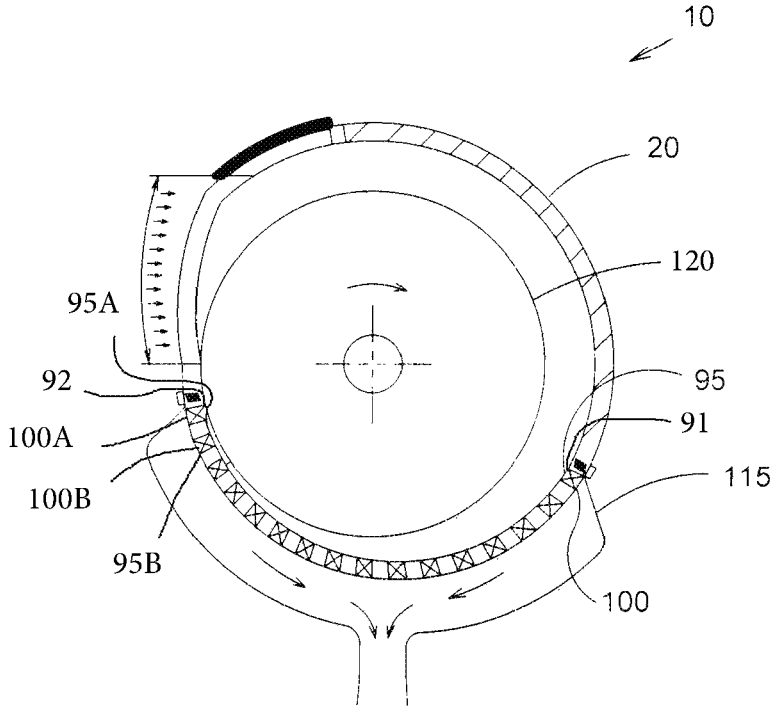
FIG. 12 is an illustration showing the location of several exhaust ports in the work region.
Figure 13:
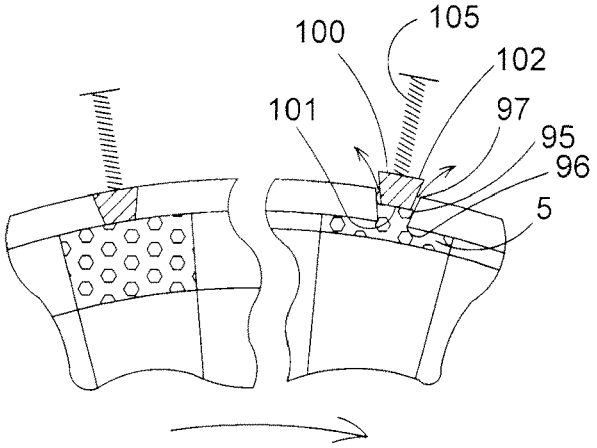
FIG. 13 is a close up view showing the geometry of a preferred embodiment of an exhaust plug.

At least one exhaust port 95 is provided. Preferably, there are several ports through the outer wall 40 of the cavity. Each port 95 has an inner end 96 and an outer end 97. The ports 95 are preferably wedge shaped or cone shaped. The port 95 farthest from the inlet 51 in the rotational direction that the vanes 130 and cavities 150 travel is the end port 95A. There is only one end port 95A. Every port 95 between the end port 95A and the inlet 51 is an intermediate port 95B. Each port 95 receives a plug 100. A plug 100 received in end port 95A is an end plug 100A. A plug 100 received in any of the intermediate port or ports 95B is an intermediate plug 100B. Each plug 100 has an inner end 101 and an outer end 102. A biasing mechanism 105 is provided to bias the plug to a position wherein it is received within the port 95. One preferred biasing mechanism is a spring. Each plug is shaped to be snuggly received within the respective port 95. A preferred structure of plug 100 is shown in FIG. 13. Preferred locations of exhaust ports are illustrated in FIG. 12. It is appreciated that spring pressure of the biasing mechanism can be minimal due to the plug and port shape configuration wherein a partial vacuum within the cavity (i.e. negative relative pressure) will naturally hold the plug in the port and any pressure within the cavity above atmospheric or ambient pressure will naturally cause the plug to exit the port to release the pressure once the spring force is overcome. Hence, the pressure at release via a particular plug is generally equal to or slightly above-ambient pressure.

A manifold 115 can be optionally bolted to the engine. The manifold 115 preferably covers all of the plugs 100 wherein any released gas can be collected and recycled through the system. It is appreciated that several plugs could successively or sequentially open as the volume within the cavity continues to decrease and the pressure accordingly rises. In this regard, anytime the cavity pressure is above a predetermined amount, a plug adjacent the cavity can open. The effective length of the work chamber can accordingly be shortened to where the first plug opens, and opening of the following plugs prevent a condition where excess pressure will cause the engine to attempt to work against itself.

Figure 23:
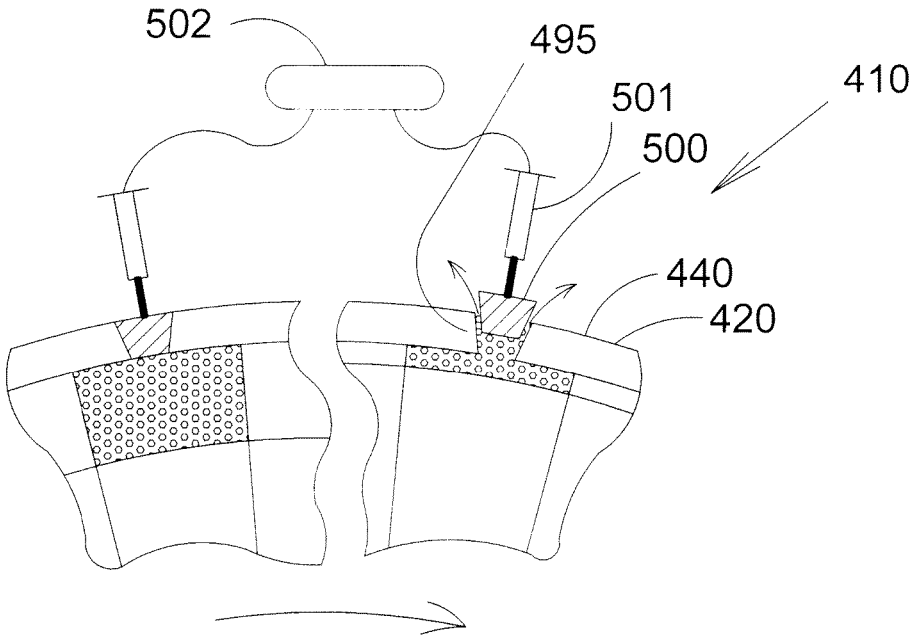
FIG. 23 is a view showing an alternative embodiment of a pressure release mechanism with a driver operated via a processor.

Turning now to FIG. 23, it is seen that an alternative embodiment is illustrated. An engine 410 is provided having a housing 420 with an outer wall 440. At least one port 495 is provided for removably receiving a plug 500. A driver 501 is provided for moving the plug to a seal position or a release position under direction of a processor 502. The plugs can be directed to open or close at any selected pressure. The driver 501 could be linear cylinders, electrical solenoids or any other structure that is operable under direction of a processor without departing from the broad aspects of the present invention.

The return region 110 is between the work region 90 and the inlet region 50. In the return region, which has a length that is preferably equal to or slightly longer than the perimeter distance at the distal end of one cavity 150, the outer wall 40 of the cavity 30 is in close proximity with the rotor perimeter 122. This close proximity between the rotor and wall exists during the entirety of the return region. The shape of the outer wall in the return region is preferably similar or the same as the outer perimeter 122 of the rotor 120 whereby the close proximity can be maintained.

Turning now to operation of the present invention, attention is called to FIGS. 1-12. For sake of simplicity, a single cavity is illustrated in the drawings. While one cavity is illustrated, it is understood that each cavity will pass through the engine regions in succession and that the effect of the cavities is cumulative.

The cavity is in the return region 110 in FIG. 1.

Figure 2:
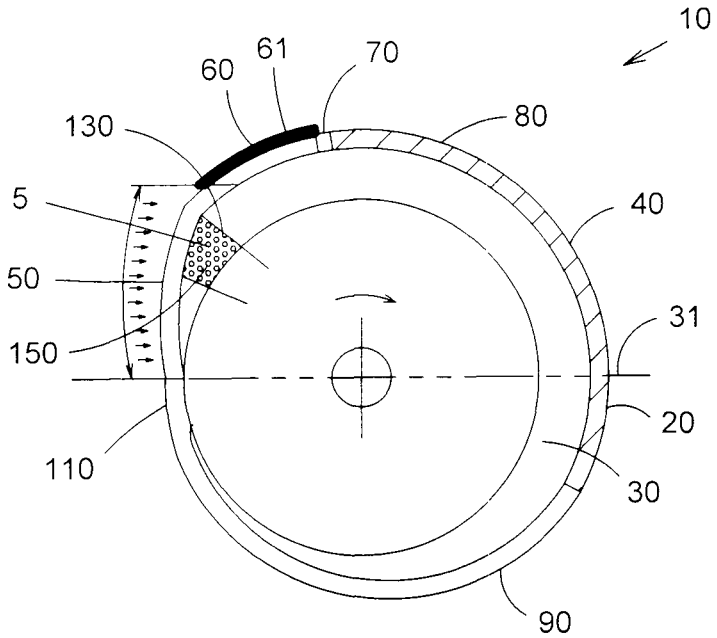
FIG. 2 is similar to FIG. 1, but shows the cavity in the inlet region.
Figure 3:
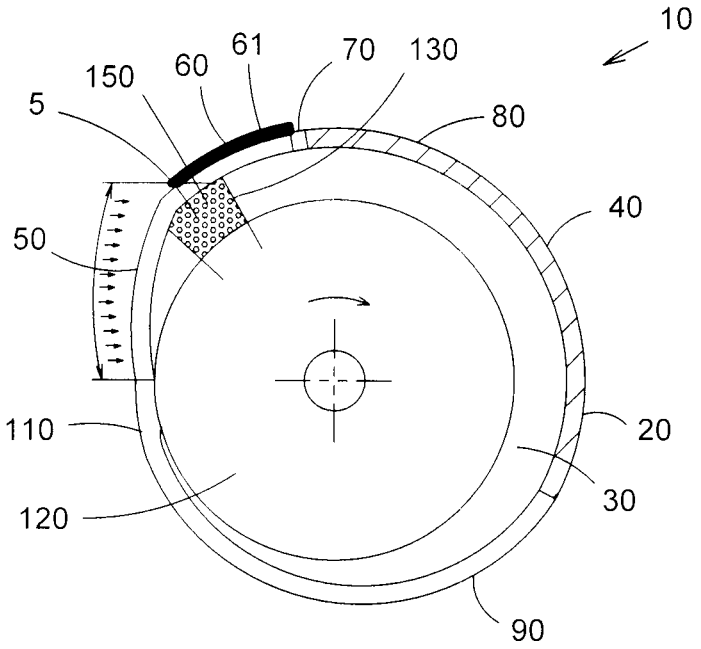
FIG. 3 is similar to FIG. 1, but shows the cavity entering the insulation region.

In FIGS. 2 and 3, the cavity 150 is in the inlet region 50. The warm or hot gas 5 enters the cavity 150 and is preferably at ambient pressure. One preferred ambient pressure is atmospheric pressure. The slot extends all the way to the beginning of the inlet region as described above so that no vacuums or partial vacuums are formed in the inlet region. The cavity 150 is at the end of the inlet region and entering the insulation region in FIG. 3. In this view the cavity has a fully supply of warm or hot gas 5.

Figure 4:
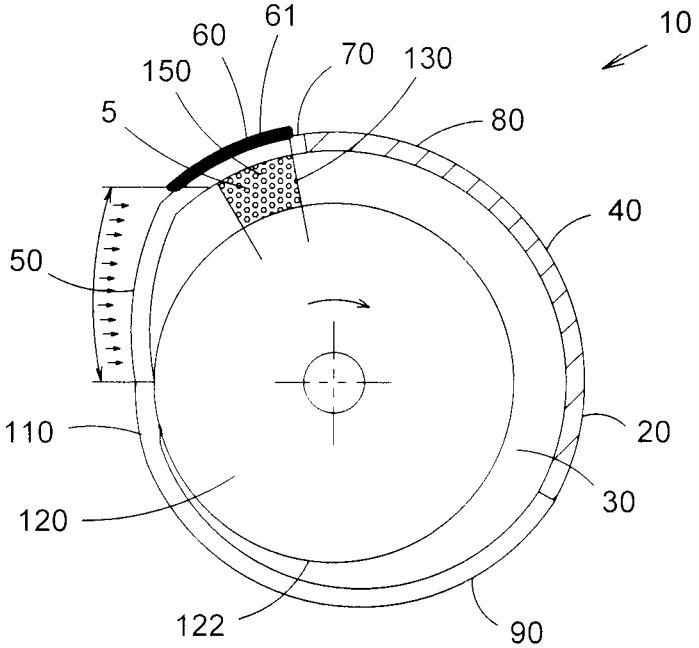
FIG. 4 is similar to FIG. 1, but shows the cavity in the insulation region just prior to the separator or thermal barrier.

In FIG. 4, the cavity 150 is in the hot or insulation region 60. The cavity is at maximum volume and is fully charged or loaded with hot gas while in the insulation region. The insulation 61 keeps the gas at it full high temperature and avoids or minimizes premature cooling. The thermal separator 70 insulates the insulation region 60 from the chill region 80.

Figure 5:
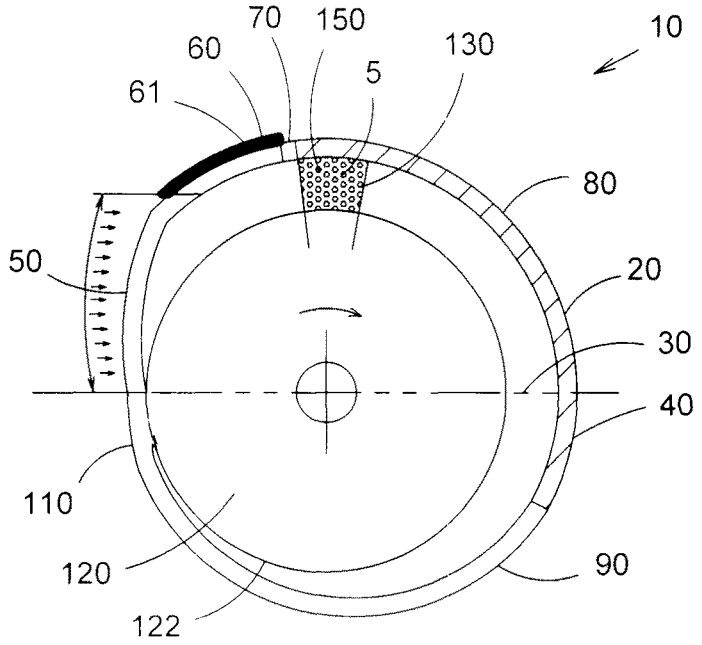
FIG. 5 is similar to FIG. 1, but shows the cavity in the start of the chill region.
Figure 6:
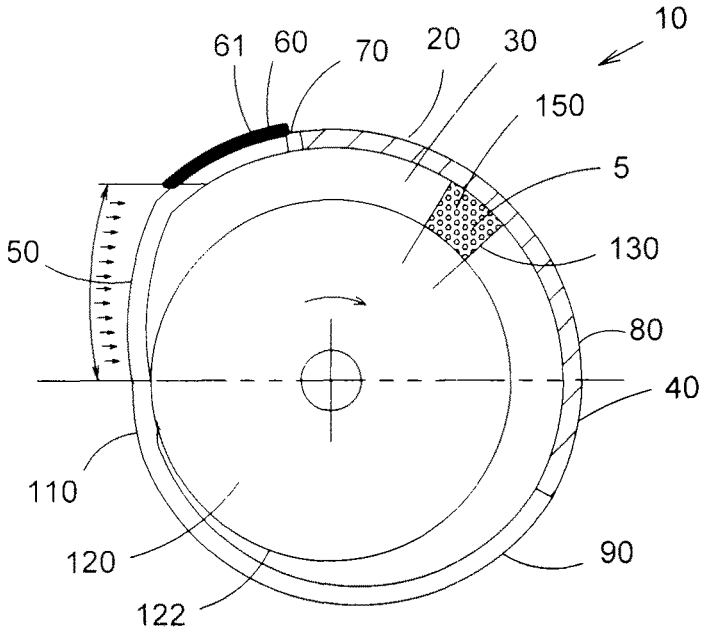
FIG. 6 is similar to FIG. 1, but shows the cavity in an intermediate position in the chill region.
Figure 7:
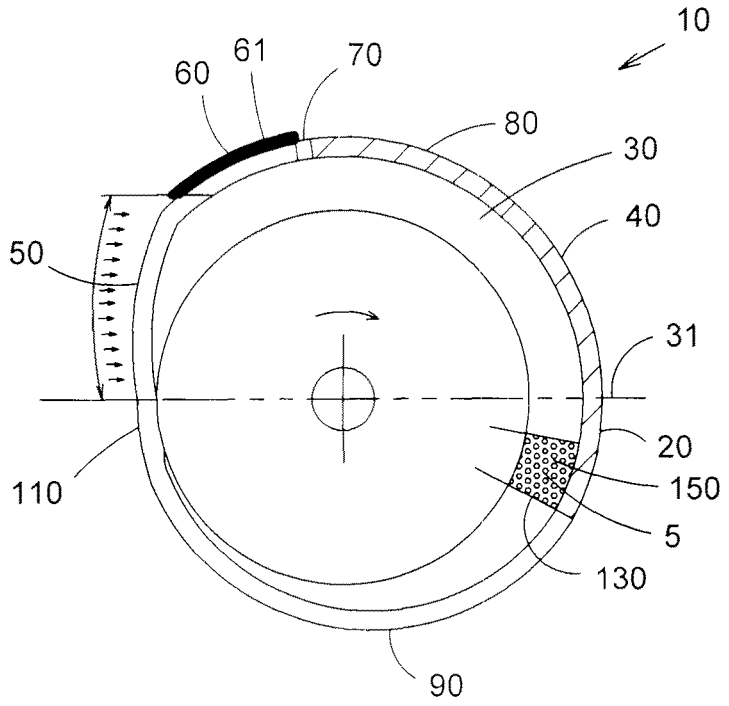
FIG. 7 is similar to FIG. 1, but shows the cavity in the end of the chill region.
Figure 8:
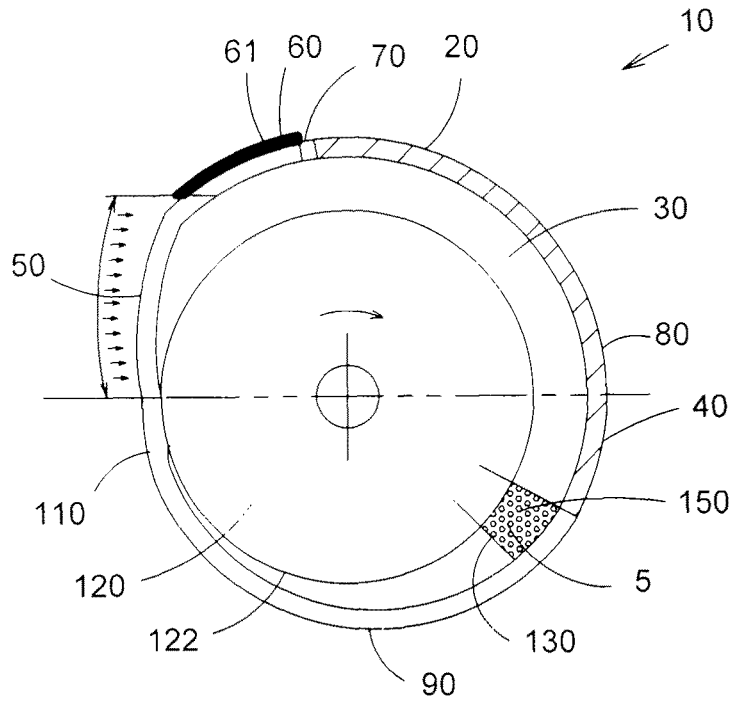
FIG. 8 is similar to FIG. 1, but shows the cavity at the start of the work region.
Figure 9:
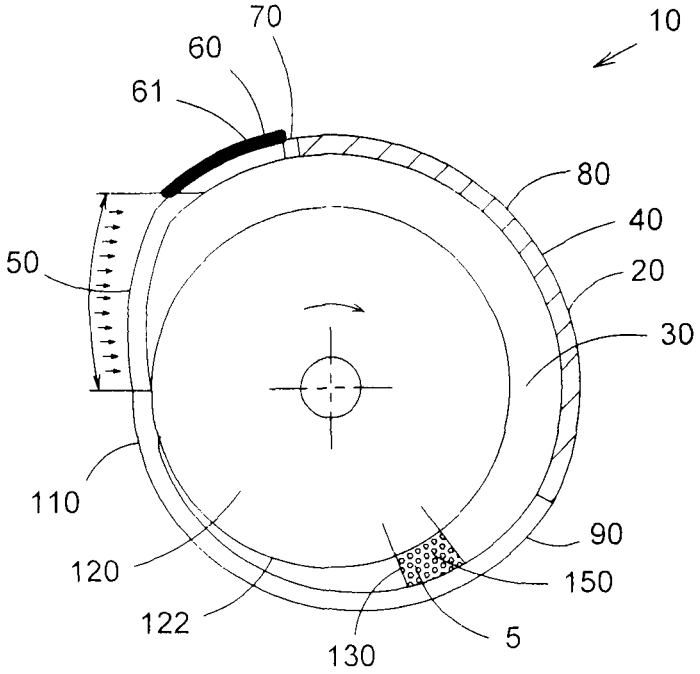
FIG. 9 is similar to FIG. 1, but shows the cavity in an intermediate position in the work region.
Figure 10:
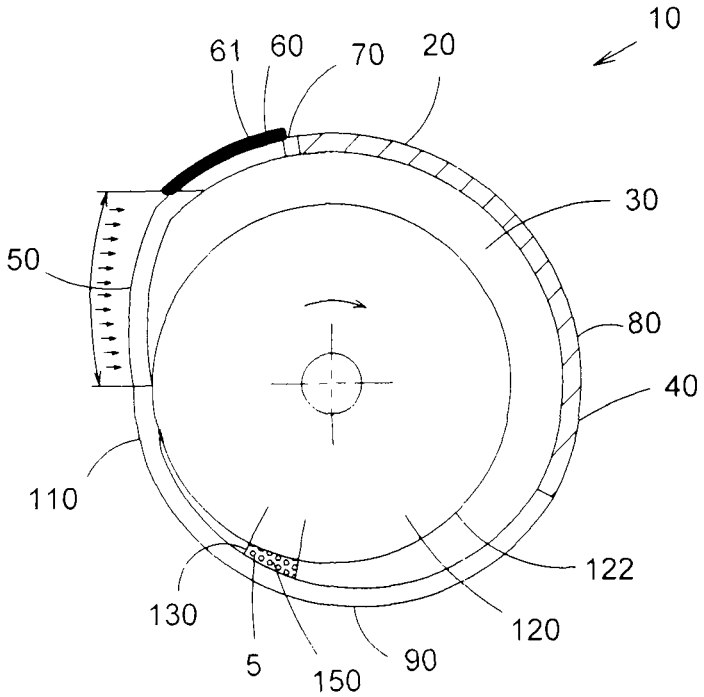
FIG. 10 is similar to FIG. 1, but shows the cavity in a second intermediate position in the work region.
Figure 11:
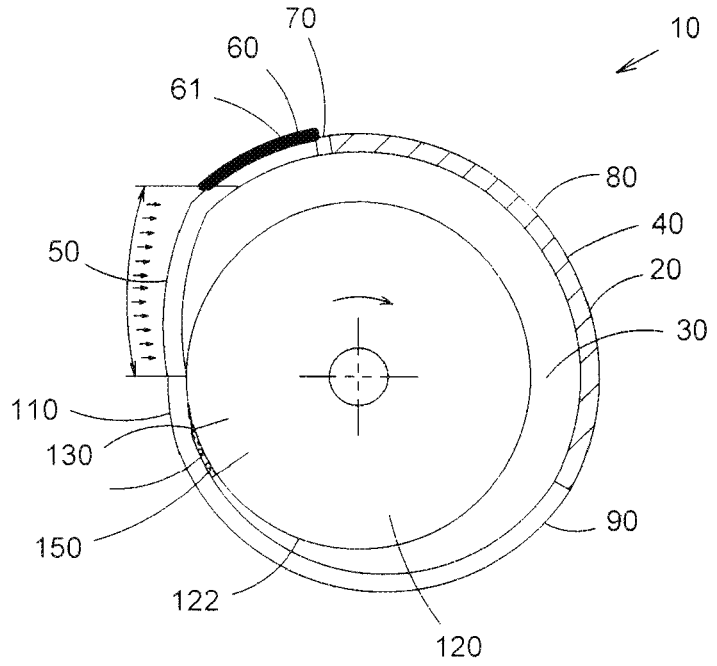
FIG. 11 is similar to FIG. 1, but shows the cavity at the end position in the work region.
Figure 18:
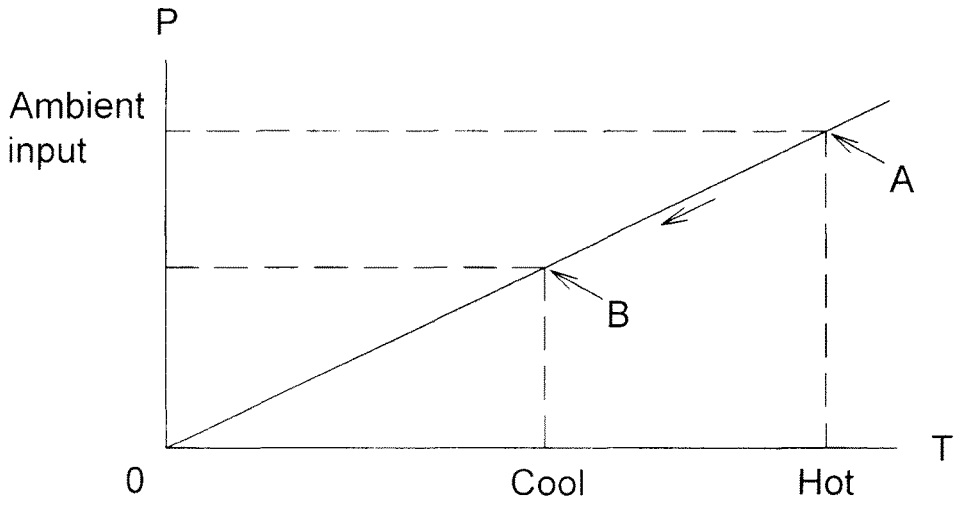
FIG. 18 is a chart showing temperature versus pressure in the chill region of the engine.

The chill region 80 is seen in FIGS. 5-7. In the chill region, the temperature drops from the high temperature to a cool temperature. The cool temperature can be equal to the ambient temperature in the preferred embodiment. The length of the chill region 80 is designed so that the temperature of the gas is at a minimum at the end of the region. Given that the cavities are at a constant volume during the entirety of the chill region, the pressure drops within each cavity in direct proportion to the temperature drop. Hence, a partial vacuum or cavity of low pressure is developed within each cavity as it passes through the chill region 80. This is shown in a diagram in FIG. 18.

Figure 19:
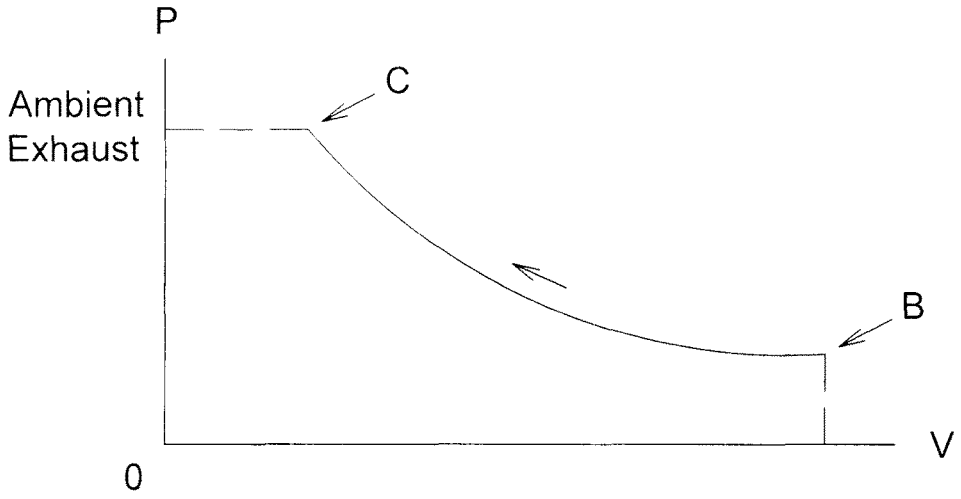
FIG. 19 is a chart of pressure versus volume during the work region of the engine.

The work region is shown in FIGS. 8-11. In the work region, the outer wall converges into closer proximity to the rotor. In this regard, the exposed or effective vane length decreases from the start of the work region to the end of the work region. The leading edge vane preferably always has a shorter length than the trailing edge vane in the work region. The force created by the partial vacuum creates a force upon the rotor due to the length differential between the leading and trailing vanes which causes the rotor to rotate. As the volume within the cavity decreases, the pressure within the cavity increases. When the pressure within the cavity increases to above ambient pressure, the pressure plug 100 is released from its respective port 95 and any excess pressure is released to the atmosphere, to the ambient environment or into the manifold 115. Doing this prevents excess pressure (i.e. pressure above ambient pressure) from developing within the cavity which would work against the operation of the engine. FIG. 19 is a chart that shows the relationship between the pressure and volume in the work section.

Figure 20:
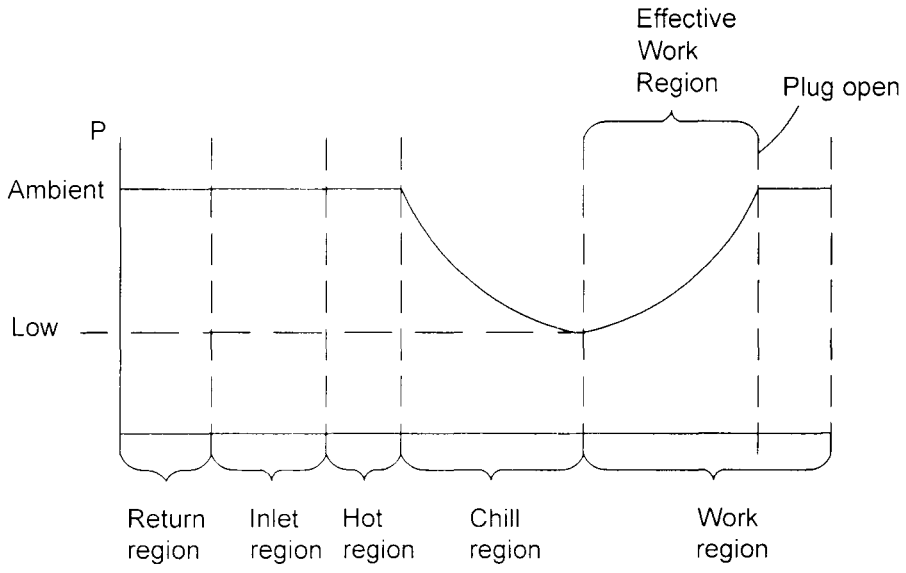
FIG. 20 is a chart showing pressure versus location throughout one revolution of the rotor.
Figure 21:
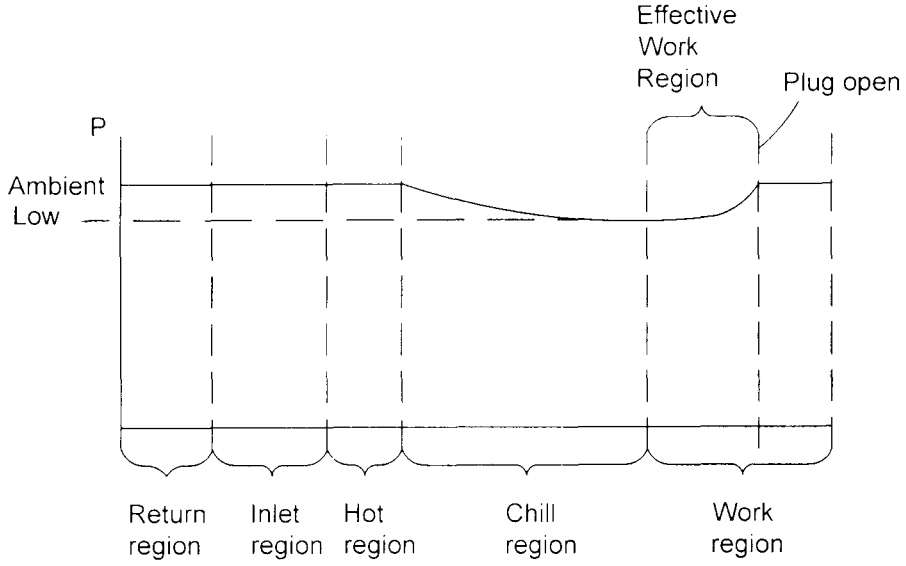
FIG. 21 is an alternative chart showing pressure versus location throughout one revolution of the rotor.

Turning now to FIGS. 20 and 21, it is seen that the pressure within the cavity 150 is shown during a complete revolution of the rotor. Two profiles are shown to illustrate examples of variation in output that can be achieved by varying the ratio of input to exhaust temperatures. The pressure within the work region returns to the ambient pressure preferably at or before the end of the work region. The plugs allow for exhaust of the gas when this condition is satisfied. In this regard the point in the chart where the pressure returns to the ambient pressure is variable and is at or before the end of the work region. The section of the graph in the work region between the chill region and where the pressure returns to ambient pressure is the effective work region. The effective work region is variable in length.

Further, the slope of the pressure within the chill region is greatest at the start of the chill region as the temperature differential between the entering gas temperature and the ambient or coolant temperature is the greatest. The slope of this line flattens as the temperature differential approaches zero.

Figure 22:
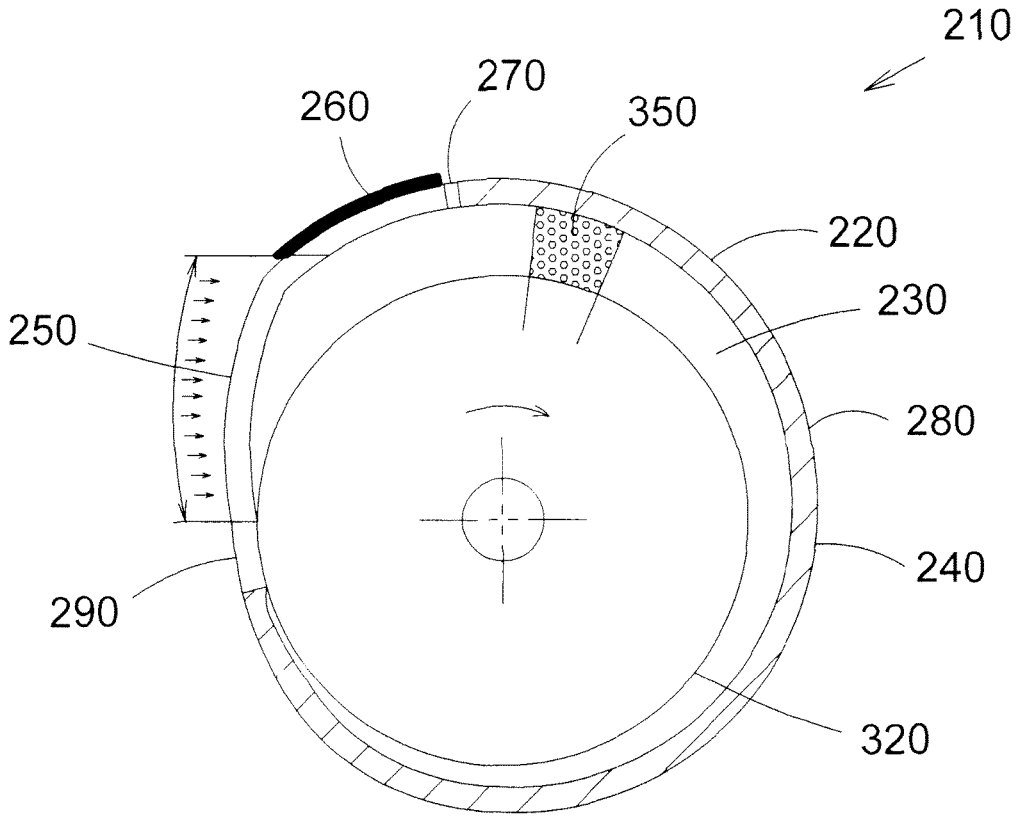
FIG. 22 shows an alternative embodiment of the present invention showing a combined cooling and working region.

Looking now to FIG. 22, it is seen that an alternative embodiment of the present invention is illustrated. An engine 210 is provided having a housing 220 with a cavity 230 and an outer wall 240. The outer wall defines an inlet region 250, an insulation region 260, a combined chill and work section 280 and a return region 290.

The inlet region 250, insulation region 260 and return region 290 are similar to the engine 10 described above. A thermal separator 270 is between the insulation region 260 and the combined chill and work region 280. A rotor 320 is provided with vanes to define cavities 350.

The difference between engine 210 and engine 10 is that in engine 210, there is a combined chill and work region 280. In region 280, work is performed while the gas temperature decreases, the volume decreases and the pressure fluctuates under the changing temperature and volume variables.

It is appreciated that the pressure at the inlet and at the outlet is preferably equal to the ambient pressure. Pressure developed by cooling gas is the driving force of the present invention.

It is further appreciated that the force developed by each cavity is cumulative and that several cavities can be in the work region at a single time.

It is appreciated that the motor could be used to drive the rotor thereby creating a compression pump.

Thus it is apparent that there has been provided, in accordance with the invention, a reverse vane engine extracting work from a hot gas that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A reverse vane engine operable via a gas comprising:
a housing with an outer wall;
a rotor, said rotor having a center, said rotor rotating relative to said housing about said center; and
a cavity defined by a first vane, a second vane, said rotor and said outer wall, said first vane and said second vane being supported by said rotor wherein said first vane and said second vane move relative to said outer wall,
wherein said cavity moves through an inlet region with an inlet, a hot region with insulation on said outer wall, a chill region with a heat exchanger on said outer wall, and a work region wherein said outer wall has a decreasing radius relative to said center of said rotor within said work region, said work region having an exhaust port at a work region end,
wherein:
said hot region allows said cavity to be filled with said gas which is a hot gas prior to moving through said chill region,
volume of said cavity is constant in said chill region whereby pressure of said gas drops as a cavity temperature drops, and
work is performed within said work region as said first vane has a shorter length between said rotor and said outer wall than said second vane as said outer wall has said decreasing radius within said work region.

2. The reverse vane engine of claim 1 wherein said inlet region comprises a slot.

3. The reverse vane engine of claim 2 wherein:
said inlet region has an inlet start and an inlet end; and
said slot spans between said inlet start and said inlet end.

4. The reverse vane engine of claim 1 wherein said gas enters the assembly at an inlet pressure and exits the assembly at an outlet pressure, said inlet pressure and said outlet pressure being approximately equal.

5. The reverse vane engine vane engine of claim 1 wherein said exhaust port is an end exhaust port receiving an end plug that is removable from said end exhaust port if pressure within said cavity is greater than an ambient pressure when said cavity reaches said end exhaust port, said reverse vane engine further comprising an intermediate exhaust port receiving an intermediate plug that is removable from said intermediate exhaust port only when pressure within said cavity is greater than said ambient pressure when said cavity reaches said intermediate exhaust port, said intermediate exhaust port being located between a start of said work region and said end exhaust port.

6. The reverse vane engine of claim 5 wherein said intermediate plug releases towards an outside of said housing.

7. The reverse vane engine of claim 5 wherein said intermediate plug is wedge shaped whereby said intermediate plug does not extend into said cavity when pressure within said cavity is less than said ambient pressure when said cavity reaches said intermediate exhaust port.

8. The reverse vane engine of claim 1 wherein said work region has a length, said length being a variable length.

9. The reverse vane engine of claim 1 wherein:

said cavity has an outer length;

said hot region has a hot region length; and said outer length is approximately equal to said hot region length.

10. The reverse vane engine of claim 1 further comprising a thermal separator between said hot region and said chill region.

11. The reverse vane engine of claim 1 wherein said cavity has a constant volume when said cavity passes through said chill region.

12. A reverse vane engine operable via a gas comprising:

a housing with an outer wall;

a rotor, said rotor having a center, said rotor rotating relative to said housing about said center; and a cavity defined by a first vane, a second vane, said rotor and said outer wall, said first vane and said second vane being supported by said rotor wherein said first vane and said second vane move relative to said outer wall, wherein said cavity moves through an inlet region with an inlet, a chill region wherein said gas within said cavity cools resulting in a reduction of a cavity pressure in said chill region, and a work region with a work region start and a work region end, said work region having an end exhaust port at said work region end and an intermediate exhaust port between said work region start and said work region end as determined by a rotational direction of travel of said cavity, said intermediate exhaust port removably receiving an intermediate plug, said intermediate plug being biased to a closed position, wherein, when said cavity reaches said intermediate exhaust port, said intermediate plug opens when said cavity pressure exceeds an ambient pressure outside of said housing to allow at least some of said gas to exit through said intermediate exhaust port, wherein work is performed within said work region as said first vane has a shorter length than said second vane as said outer wall has a decreasing radius within said work region.

13. The reverse vane engine of claim 12 wherein said intermediate plug is wedge shaped.

14. A reverse vane engine operable via a gas comprising:

a housing with an outer wall;

a rotor, said rotor having a center, said rotor rotating relative to said housing about said center; and a cavity defined by a first vane and a second vane, said rotor and said outer wall, said first vane and said second vane being supported by said rotor wherein said first vane and said second vane move relative to said outer wall, wherein said cavity moves through an inlet region with an inlet, a chill region wherein said gas within said cavity cools resulting in a reduction of a cavity pressure in said chill region, and a work region wherein said outer wall has a decreasing radius relative to said center of said rotor, said work region having a work region start and a work region end as determined by a rotational direction of travel of said cavity, said work region radially having at least two exhaust ports each with a plug operably associated therewith, each of said plug operably associated therewith opening when said cavity pressure exceeds an ambient pressure outside of said housing and remaining closed when said cavity pressure is less than said ambient pressure when said cavity respectively passes each of said at least two exhaust ports, wherein said reverse engine has an effective work region that is variable in length defined radially starting at said work region start and terminating at the first one of said at least two exhaust ports wherein said plug operably associated therewith is open, and wherein work is performed within said work region as said first vane has a shorter length than said second vane as said outer wall has said decreasing radius within said work region.

* * * * *